US008298988B2

(12) United States Patent
Sawada

(10) Patent No.: US 8,298,988 B2
(45) Date of Patent: Oct. 30, 2012

(54) THERMAL TRANSFER SHEET

(75) Inventor: Masakazu Sawada, Kanagawa (JP)

(73) Assignee: Sony Corporation, Tokyo (JP)

( * ) Notice: Subject to any disclaimer, the term of this patent is extended or adjusted under 35 U.S.C. 154(b) by 528 days.

(21) Appl. No.: 12/435,506

(22) Filed: May 5, 2009

(65) Prior Publication Data

US 2009/0280275 A1 Nov. 12, 2009

(30) Foreign Application Priority Data

May 9, 2008 (JP) ..... 2008-123668

(51) Int. Cl.
*B41M 5/40* (2006.01)
*B41M 5/50* (2006.01)
*B41M 5/382* (2006.01)

(52) U.S. Cl. ..... 503/227; 428/32.64; 428/32.87; 8/471

(58) Field of Classification Search ..... 428/32.64, 428/32.87; 503/227; 8/471
See application file for complete search history.

(56) References Cited

U.S. PATENT DOCUMENTS 5,593,940 A * 1/1997 Umise et al. ..... 503/227

FOREIGN PATENT DOCUMENTS

| | | | |
|---|---|---|---|
| JP | 02-145395 | | 4/1990 |
| JP | 04-329193 | | 11/1992 |
| JP | 05-286271 | | 2/1993 |
| JP | 05-229271 | | 7/1993 |
| JP | 08-073754 | * | 3/1996 |
| JP | 10-035122 | | 2/1998 |
| JP | 2983833 | | 9/1999 |

OTHER PUBLICATIONS

Japanese Office Action dated Apr. 17, 2012 for Japanese Application No. 2008-123668.

* cited by examiner

*Primary Examiner* — Gerard Higgins
*Assistant Examiner* — Sathavaram I Reddy
(74) *Attorney, Agent, or Firm* — SNR Denton US LLP

(57) ABSTRACT

A thermal transfer sheet includes a thermal transfer dye layer containing a dye on one surface of a base material sheet and a heat-resistant lubricating layer on the other surface, wherein the heat-resistant lubricating layer contains at least one type of silicone compound represented by Chemical formula 1 or Chemical formula 2 described below.

[Chemical compound 1]

Chemical formula 1

[Chemical compound 2]

Chemical formula 2

In Chemical formula 1 and Chemical formula 2, $R_1$ contains an alkyl group, an alkylene group, or a phenyl group and may have an ether or ester bond, $R_2$ represents an alkyl group or an alkylene group having the carbon number of 1 to 50, and n and m represent individually an integer of 1 or more, and or less.

3 Claims, 4 Drawing Sheets

THERMAL TRANSFER SHEET

BACKGROUND OF THE INVENTION

1. Field of the Invention

The present invention relates to a thermal transfer sheet in which a silicone compound is used for a heat-resistant lubricating layer. In particular, it relates to a thermal transfer sheet excellent in running smoothness during transfer and preservation stability of dye.

2. Description of the Related Art

A thermal transfer system by using a sublimation dye transfers many color dots to a transfer receiver through very short time heating so as to reproduce a full color image based on the color dots of a plurality of colors.

In this thermal transfer system, a so-called sublimation thermal transfer sheet, in which a dye layer composed of a sublimation dye and a binder is disposed on one surface of a base material sheet, e.g., a polyester film, is used as a thermal transfer sheet.

In the thermal transfer system, a thermal transfer sheet is heated from the back with a thermal head in accordance with image information so as to transfer a dye contained in a dye layer to a transfer receiver (photographic paper) and, thereby, form an image.

At this time, regarding the thermal transfer sheet, it is desired that a surface on the side coming into contact with the thermal head stably exhibits low friction over low density image printing to high density image printing. In general, the thermal transfer sheet is provided with a heat-resistant lubricating layer on the surface opposite to the surface, on which the dye layer is disposed, in order to prevent fusion with the thermal head and give smooth running smoothness.

In image printing on the photographic paper by using a thermal transfer sheet, heat is applied to the heat-resistant lubricating layer from the thermal head and, thereby, a dye in the dye layer on the opposite surface is transferred to the photographic paper. The color formation density is proportionate to an amount of heat, and the surface temperature of the thermal head changes by a few hundreds of degrees, correspondingly. Consequently, when the thermal transfer sheet moves on the thermal head, the friction coefficient between the thermal head and the heat-resistant lubricating layer changes easily because of the temperature change. If the friction coefficient between the thermal head and the heat-resistant lubricating layer changes, movement of the thermal transfer sheet at a constant speed becomes difficult and, thereby, it is difficult to obtain a sharp image.

For example, in the case where the friction coefficient is large, movement of the thermal transfer sheet becomes slow temporarily, and the density of merely that portion may become high. That is, so-called sticking (linear variations in image printing) may occur.

In order to prevent this sticking, it is desirable that the friction coefficient at, in particular, high temperatures is reduced. As for lubricants for reducing the friction coefficient at high temperatures, phosphate esters and fatty acid esters have been used previously, and the phosphate esters and the fatty acid esters have been contained in the heat-resistant lubricating layers (for example, refer to Japanese Unexamined Patent Application Publication No. 10-35122).

However, the phosphate esters and the fatty acid esters are volatilized or decomposed by heat from the thermal head so as to stain the thermal head. If image printing is conducted repeatedly with this stained thermal head, adhered materials are baked on the thermal head surface and, as a result, variations in image printing and the like occur in the image printing.

Furthermore, in the case where the thermal transfer sheet is preserved in a rolled state, contact between the dye layer and the heat-resistant lubricating layer occurs. In particular, in a state of high temperature preservation, the phosphate esters and the fatty acid esters having low melting points and high solvency dissolve a part of dye in the dye layer. Consequently, reduction in the density, variations in image printing, and the like occur in the image printing.

As for the lubricant for reducing the friction coefficient, silicone oils are used (for example, refer to Japanese Unexamined Patent Application Publication No. 04-329193).

Regarding the thermal transfer sheet including the silicone oil as well, since the silicone oil is a liquid at ambient temperature, in the case where the thermal transfer sheet is preserved in a rolled state, contact between the dye layer and the heat-resistant lubricating layer occurs, so that a part of dye in the dye layer is eluted. Consequently, reduction in the density, variations in image printing, and the like occur in the image printing.

Moreover, Japanese patent No. 2983833 discloses that an amide-containing silicone compound, which is an internal mold-release agent for toner and which is a solid at ambient temperature, is used. However, this amide-containing silicone compound is not used for the thermal transfer sheet but is applied to the internal additive for toner so as to improve the offset resistance and the clinging resistance while ensuring the low-temperature fixing performance of the toner.

SUMMARY OF THE INVENTION

The present inventors have recognized the above-described circumstances. It is desirable to provide a thermal transfer sheet which is capable of realizing a stable, low friction coefficient in the range of heating temperature through the use of a heating device and which is excellent in preservation stability without staining the heating device nor adversely affecting a thermal transfer dye layer.

According to an embodiment of the present invention, a thermal transfer sheet includes a thermal transfer dye layer containing a dye on one surface of a base material sheet and a heat-resistant lubricating layer on the other surface, wherein the heat-resistant lubricating layer contains at least one type of silicone compound represented by Chemical formula 1 or Chemical formula 2 described below,

[Chemical compound 1]

Chemical formula 1

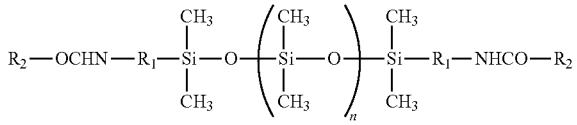

-continued

[Chemical compound 2]

Chemical formula 2

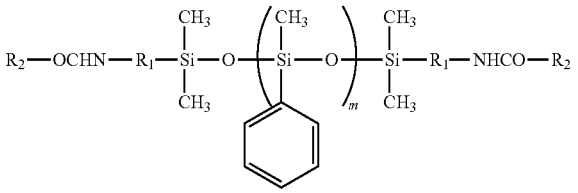

where in Chemical formula 1 and Chemical formula 2, $R_1$ contains an alkyl group, an alkylene group, or a phenyl group and may have an ether or ester bond, $R_2$ represents an alkyl group or an alkylene group having the carbon number of 1 to 50, and n and m represent individually an integer of 1 or more, and 200 or less.

According to an embodiment of the present invention, at least one type of silicone compound represented by Chemical formula 1 or Chemical formula 2 is contained in the heat-resistant lubricating layer. Therefore, excellent lubricity is obtained and a low friction coefficient can be achieved even at high temperatures. Furthermore, according to an embodiment of the present invention, the silicone compound contained in the heat-resistant lubricating layer and represented by Chemical formula 1 or Chemical formula 2 has a high melting point and low volatility and is hard to decompose in contrast to a silicone oil which is oily at room temperature. Consequently, the heating device and the dye layer are not adversely affected and excellent preservation stability is exhibited.

DESCRIPTION OF THE PREFERRED EMBODIMENTS

A thermal transfer sheet according to an embodiment of the present invention will be described below in detail with reference to the drawings.

Figure 1:
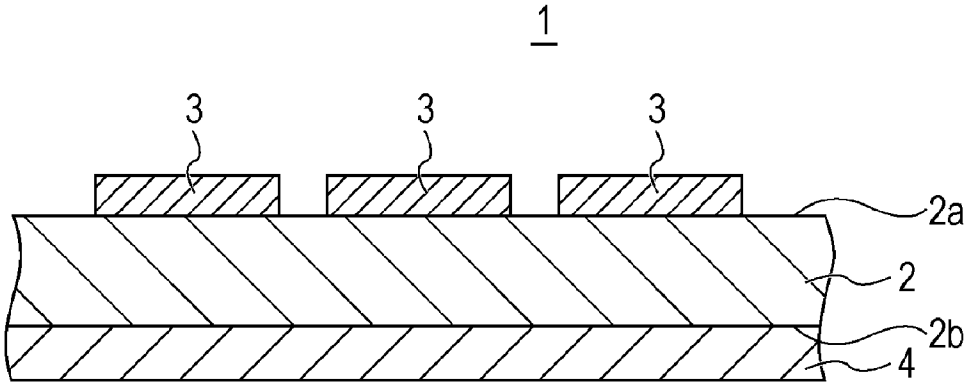
FIG. 1 is a sectional view of a thermal transfer sheet according to an embodiment of the present invention.

Regarding a thermal transfer sheet 1, as shown in FIG. 1, thermal transfer dye layers 3 containing a dye are disposed on one surface 2*a* of a base material sheet 2 and, in addition, a heat-resistant lubricating layer 4 for facilitating the running smoothness is disposed on the other surface 2*b* opposite to the one surface 2*a*.

The final form of a product of this thermal transfer sheet 1 is in the state of being rolled into the shape of a roll, and the base material sheet 2 constitutes stacked sheets. That is, the thermal transfer sheet 1 is rolled into the shape of a roll, and the thermal transfer dye layers 3 disposed on the one surface 2*a* of the base material sheet 2 and the heat-resistant lubricating layer 4 disposed on the other surface 2*b* are stacked while facing each other. As described above, the thermal transfer sheet 1 is preserved as a final product in the state in which the thermal transfer dye layers 3 and the heat-resistant lubricating layer 4 are stacked while facing each other.

The thermal transfer sheet 1 rolled into the shape of a roll is mounted on a thermal transfer printer provided with, for example, a thermal head serving as a heating device, the thermal transfer dye layers 3 are heated from the heat-resistant lubricating layer 4 side with the thermal head and, thereby, the dye is transferred to a transfer receiver, e.g., photographic paper, fed into the thermal transfer printer, so that an image is formed.

Specifically, various base materials in the related art can be used for the base material sheet 2. For example, polyester films, polystyrene films, polypropylene films, polysulfone films, polycarbonate films, polyimide films, and aramid films can be used. The thickness of this base material sheet 2 is determined at will. For example, the thickness is 1 to 30 μm, and preferably 2 to 10 μm.

Figure 2:
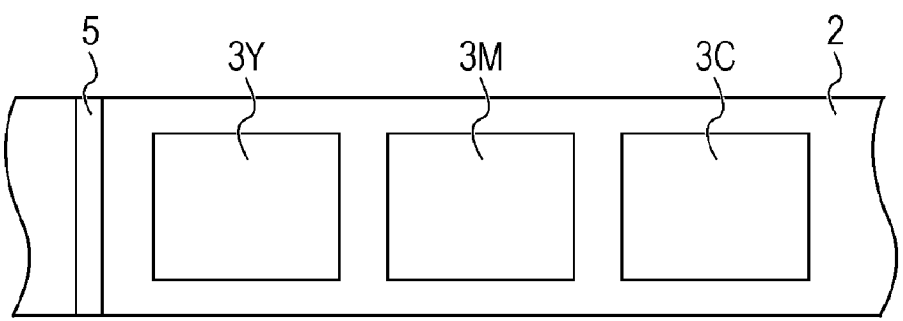
FIG. 2 is a plan view of a thermal transfer sheet having thermal transfer dye layers of yellow, magenta, and cyan and a detection mark.
Figure 3:
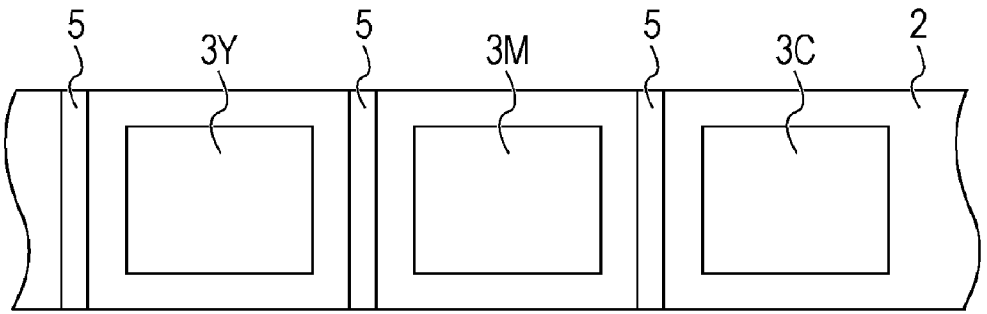
FIG. 3 is a plan view of a thermal transfer sheet having thermal transfer dye layers of yellow, magenta, and cyan and detection marks.
Figure 4:
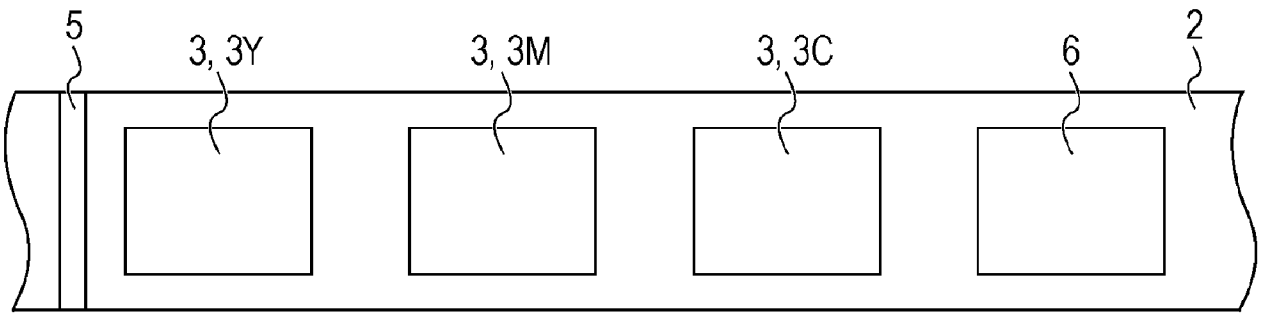
FIG. 4 is a plan view of a thermal transfer sheet having a transfer protective layer.
Figure 5:
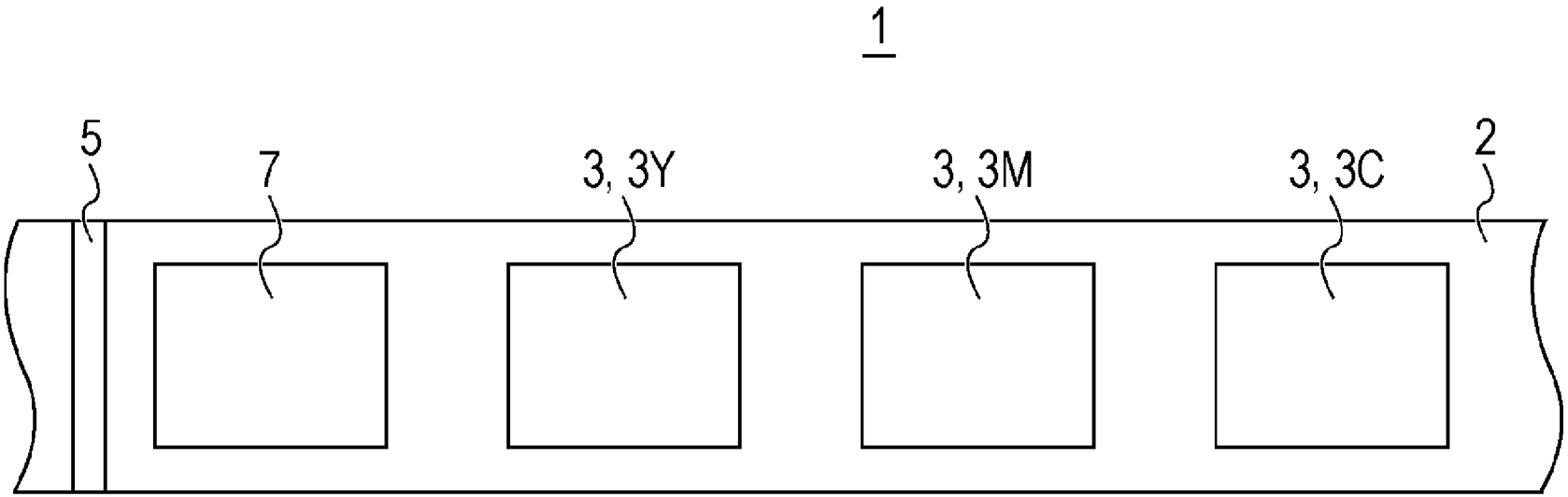
FIG. 5 is a plan view of a thermal transfer sheet having a transfer pattern receiving layer.

At least the thermal transfer dye layers 3 are disposed on the one surface 2*a* of this base material sheet 2, that is, the surface on the side facing the photographic paper. Besides the thermal transfer dye layers 3, if necessary, detection marks 5 for detecting positions, as shown in FIG. 2 and FIG. 3, an image protective layer 6 for protecting a formed image, as shown in FIG. 4, and a transfer pattern receiving layer 7 for receiving a dye, as shown in FIG. 5, may be disposed.

In the case of monochrome, as shown in FIG. 1, a plurality of thermal transfer dye layers 3 may be disposed on the base material sheet 2, or a continuous layer may be disposed on all over the base material sheet 2. Furthermore, regarding the thermal transfer dye layers 3, as shown in FIG. 2, a yellow thermal transfer dye layer 3Y, a magenta thermal transfer dye layer 3M, and a cyan thermal transfer dye layer 3C of yellow, magenta, and cyan, respectively, may be disposed separately and sequentially in order to respond to an full color image.

The yellow thermal transfer dye layer 3Y, the magenta thermal transfer dye layer 3M, and the cyan thermal transfer dye layer 3C are formed from at least a binder and dyes of respective colors. Binders in the related art can be used for the binder. Examples thereof include organic solvents and water-soluble resins, e.g., water-soluble resins of cellulose base, acrylic acid base, starch base, and the like, acrylic resins, polyphenylene oxide, polysulfone, polyether sulfone, and acetyl cellulose. From the viewpoint of the recording sensitivity and the preservation stability of a transfer member, binders having heat distortion temperatures of 70° C. to 150° C. are excellent. Preferable examples of such binders include polystyrenes, polyvinylbutyrals, polycarbonates, methacrylic resins, acrylonitrile-styrene copolymers, polyester resins, urethane resins, chlorinated polyethylenes, and chlorinated polypropylenes.

Any dye can be used. For example, as for the yellow dye, azo dyes, disazo dyes, methine dyes, pyridone-azo dyes, and the like and mixtures thereof can be used. As for the magenta dye, azo dyes, anthraquinone dyes, styryl dyes, heterocyclic azo dyes, and mixtures thereof can be used. As for the cyan dyes, indoaniline dyes, anthraquinone dyes, naphthoquinone dyes, heterocyclic azo dyes, and mixtures thereof can be used.

The order of formation of the thermal transfer dye layers 3 is not limited to the order of the yellow thermal transfer dye layer 3Y, the magenta thermal transfer dye layer 3M, and the cyan thermal transfer dye layer 3C. The order may be changed appropriately, and the formation may be repeated. As for the thermal transfer dye layers 3, besides the yellow thermal transfer dye layer 3Y, the magenta thermal transfer dye layer 3M, and the cyan thermal transfer dye layer 3C, a black thermal transfer dye layer may be further added and they may be formed repeatedly.

As shown in FIG. 2, the detection mark 5 for detecting the position is disposed between the yellow thermal transfer dye layer 3Y and the cyan thermal transfer dye layer 3C in such a way that a group composed of the yellow thermal transfer dye layer 3Y, the magenta thermal transfer dye layer 3M, and the cyan thermal transfer dye layer 3C can be detected in the case where this group is disposed repeatedly. Furthermore, as shown in FIG. 3, the detection marks 5 may be disposed between the yellow thermal transfer dye layer 3Y and the magenta thermal transfer dye layer 3M, between the magenta thermal transfer dye layer 3M and the cyan thermal transfer dye layer 3C, and between the yellow thermal transfer dye layer 3Y and the cyan thermal transfer dye layer 3C so as to detect the thermal transfer dye layers 3Y, 3M, and 3C of respective colors.

Furthermore, as shown in FIG. 4, a transparent transfer protective layer 6 for protecting a print image surface by being transferred to the print image surface after the image printing may be disposed following the thermal transfer dye layers 3 or the yellow thermal transfer dye layer 3Y, the magenta thermal transfer dye layer 3M, and the cyan thermal transfer dye layer 3C (hereafter may be referred to as thermal transfer dye layers 3 (3Y, 3M, 3C)).

Moreover, in the case where normal paper is used as the photographic paper, as shown in FIG. 5, a transfer pattern receiving layer 7 to be transferred to the normal paper may be disposed toward the front of the thermal transfer dye layers 3 or the yellow thermal transfer dye layer 3Y, the magenta thermal transfer dye layer 3M, and the cyan thermal transfer dye layer 3C and, thereby, a transfer pattern receiving layer 7 for receiving the dye may be formed on a normal paper surface prior to transfer of the thermal transfer dye layers 3 or the yellow thermal transfer dye layer 3Y, the magenta thermal transfer dye layer 3M, and the cyan thermal transfer dye layer 3C.

As shown in FIG. 1, on the other surface 2*b* of the above-described base material sheet 2, the heat-resistant lubricating layer 4 is disposed for facilitating the running smoothness because the thermal transfer sheet 1 runs while being in contact with the thermal head.

This heat-resistant lubricating layer 4 is primarily composed of a binder and contains at least a silicone compound serving as a lubricant.

Any binder in the related art can be used for the binder. For example, cellulose acetates, polyvinyl acetals, and acrylic resins can be used. Furthermore, the binder may be cross-linked with a polyisocyanate compound in consideration of the heat resistance, the stability, and the like.

As for the polyisocyanate compound to be used, any isocyanate compound having at least two isocyanate groups in the molecule can be used. For example, torylene diisocyanate, 4,4'-diphenylmethane diisocyanate, 4,4'-xylene diisocyanate, hexamethylene diisocyanate, 4,4'-methylenebis(cyclohexyl isocyanate), methylcyclohexane-2,4-diisocyanate, methylcyclohexane-2,6-diisocyanate, 1,3-di(methyl diisocyanate)cyclohexane, isophorone diisocyanate, trimethylhexamethylene diisocyanate, and the like and adducts (polyisocyanate prepolymers) produced by a partial addition reaction of diisocyanate and polyol, for example, adducts produced by reacting torylene diisocyanate with trimethylol propane, can be used.

Examples of silicone compounds can include silicone compounds represented by Chemical formula 1 and Chemical formula 2 described below. The heat-resistant lubricating layer 4 contains at least one type of silicone compound represented by Chemical formula 1 or Chemical formula 2.

[Chemical compound 3]

Chemical formula 1

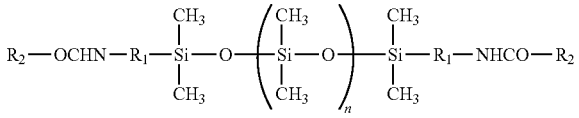

[Chemical compound 4]

Chemical formula 2

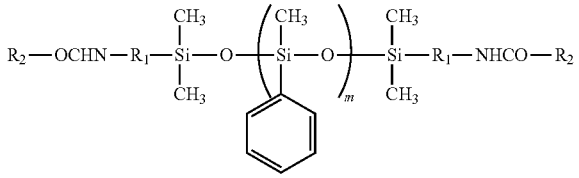

In Chemical formula 1 and Chemical formula 2, $R_1$ contains an alkyl group, an alkylene group, or a phenyl group and may have an ether or ester bond, $R_2$ represents an alkyl group or an alkylene group having the carbon number of to 50, and n and m represent individually an integer of 1 or more, and 200 or less. The carbon number of $R_2$ is specified to be 1 to 50 and, thereby, appropriate lubricity can be provided to the heat-resistant lubricating layer 4. The coating performance is facilitated and layer separation of the heat-resistant lubricating layer 4 can be prevented by specifying n and m to be 200 or less.

The silicone compounds represented by Chemical formula 1 and Chemical formula 2 give the lubricity to the heat-resistant lubricating layer 4, and since the melting point is high, even when the thermal transfer sheet 1 is rolled and preserved while the thermal transfer dye layers 3 and the heat-resistant lubricating layer 4 are stacked while facing each other, the dye is not eluted from the thermal transfer dye layers 3 (3Y, 3M, 3C). Furthermore, the silicone compounds represented by Chemical formula 2 have a phenyl group and, therefore, in the case where a resin having a phenyl group is used as the binder, good compatibility with the binder is exhibited.

The silicone compounds represented by Chemical formula 1 and Chemical formula 2 will be described below specifically.

[Chemical compound 5]

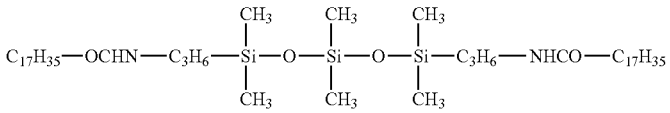

-continued
[Chemical compound 6]
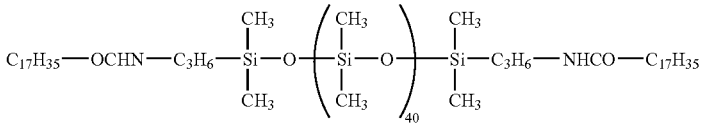
[Chemical compound 7]
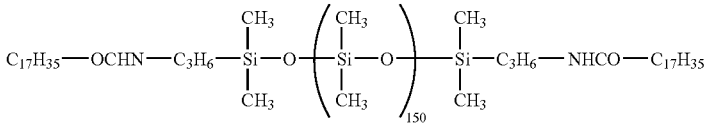
[Chemical compound 8]
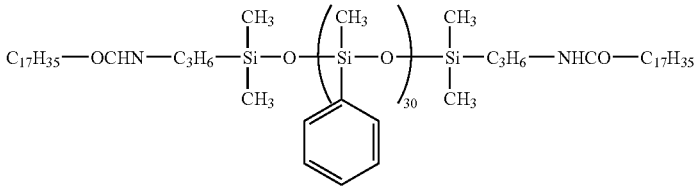
[Chemical compound 9]
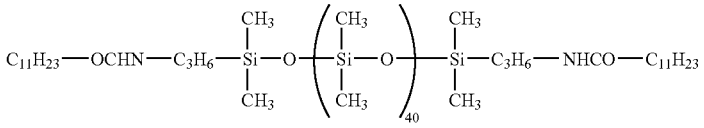
[Chemical compound 10]
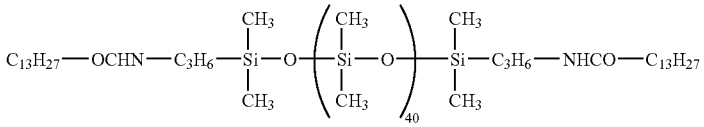
[Chemical compound 11]
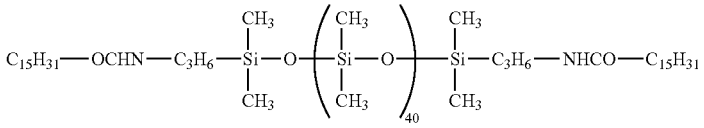
[Chemical compound 12]
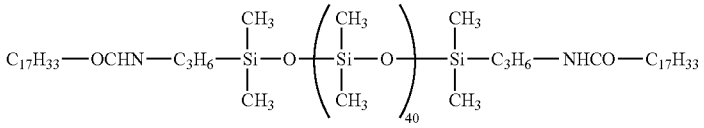
[Chemical compound 13]
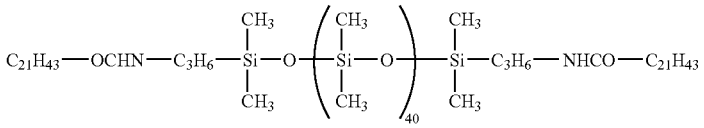
[Chemical compound 14]
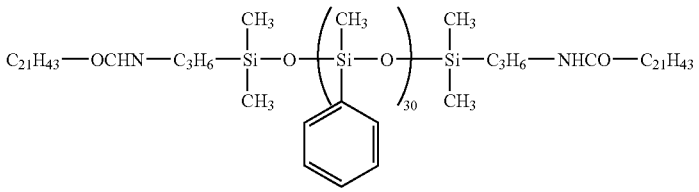
[Chemical compound 15]
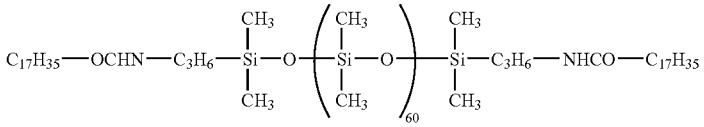

-continued
[Chemical compound 16]
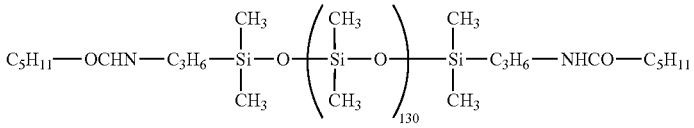
[Chemical compound 17]
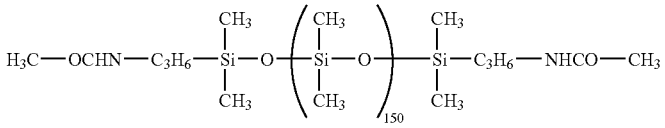
[Chemical compound 18]
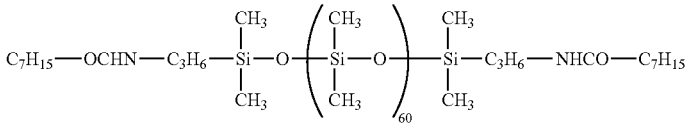
[Chemical compound 19]
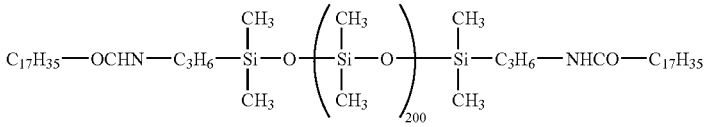
[Chemical compound 20]
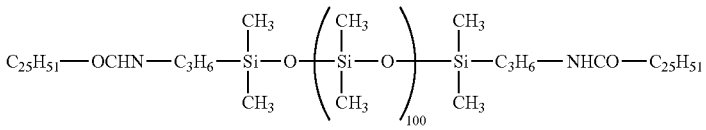
[Chemical compound 21]
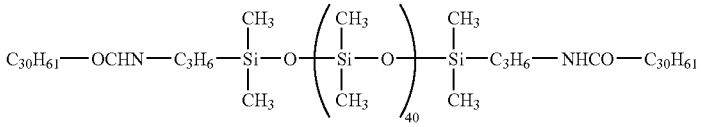
[Chemical compound 22]
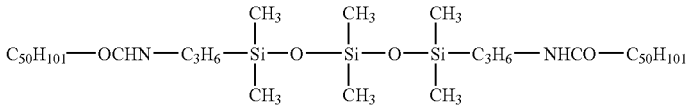
[Chemical compound 23]
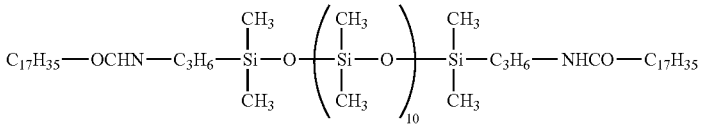
[Chemical compound 24]
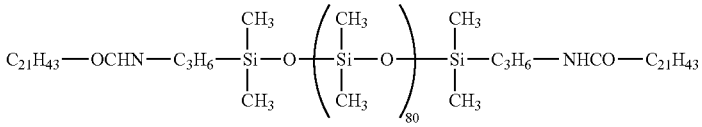
[Chemical compound 25]
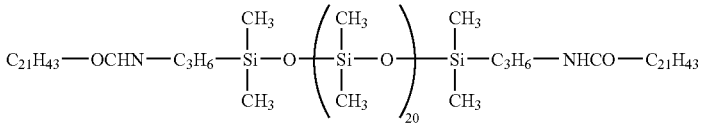
[Chemical compound 26]
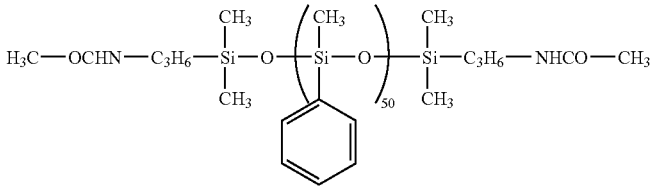

-continued

[Chemical compound 27]

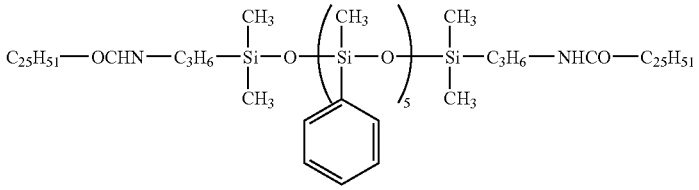

[Chemical compound 28]

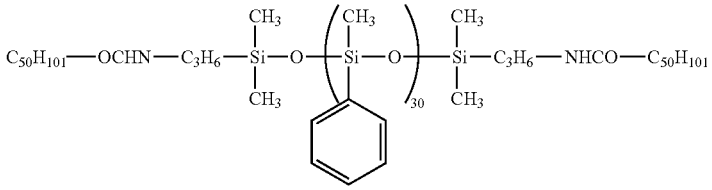

[Chemical compound 29]

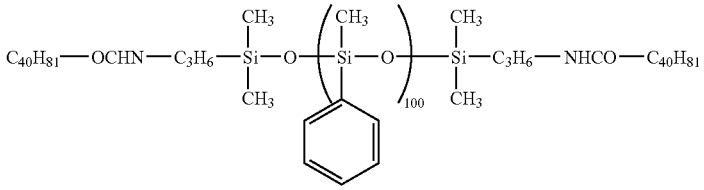

[Chemical compound 30]

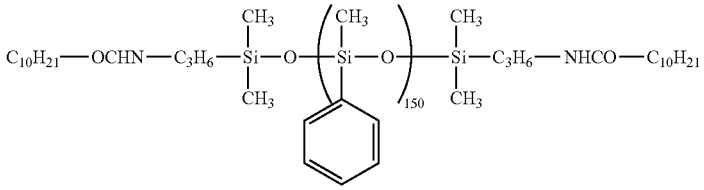

[Chemical compound 31]

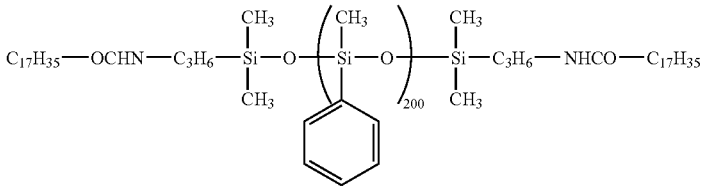

In Chemical compound 5 to Chemical compound 31 described above, $R_1$ represents $C_3H_6$, although not limited to this.

It is preferable that the amount of addition of silicone compounds represented by Chemical formula 1 and Chemical formula 2 is within the range of 10 to 20 percent by mass relative to the heat-resistant lubricating layer 4. If this amount of addition is specified to be 10 percent by mass or more, a sufficient effect is exerted and a sufficient friction reduction effect is exerted. If the amount is specified to be 20 percent by mass or less, the content of the binder in the heat-resistant lubricating layer 4 does not become too small, the coating film properties can be maintained, and the dye preservation performance is not adversely affected.

Moreover, the silicone compounds represented by Chemical formula 1 and Chemical formula 2 have high melting points of 59° C. or higher and low volatility and are hard to decompose. If the melting point of the contained silicone compound represented by Chemical formula 1 or Chemical formula 2 is about 50° C., in the case where preservation after rolling is conducted in a high-temperature environment, the dyes in the thermal transfer dye layers 3 (3Y, 3M, 3C) are eluted and the dyes are moved into the heat-resistant lubricating layer 4. In the case where the silicone compound represented by Chemical formula 1 or Chemical formula 2 has a melting point of 59° C. or higher and low volatility and is hard to decompose, even when preservation after rolling is conducted in a high-temperature environment, the dyes are not moved into the heat-resistant lubricating layer 4, a reduction in density, an occurrence of image printing variations, and the like can be prevented, and staining of the thermal head can be prevented.

The heat-resistant lubricating layer 4 may contain other various lubricants besides the above-described silicone compounds. Examples of other lubricants include polyglycerin fatty acid esters, phosphate esters, fatty acid esters, and fatty acid amides.

Preferably, the amount of addition in the case where other lubricants are mixed is specified in such a way that the total amount of addition of lubricants (the total amount of the silicone compound and the other lubricants) is 50% or less. If the proportion made up by the lubricants other than the silicone compound exceeds 50%, the proportion of the silicone compound is reduced relatively and the friction coefficient on the high-temperature side increases.

The heat-resistant lubricating layer 4 may contains, for example, a filler as necessary, besides the binder and the silicone compounds represented by Chemical formula 1 and Chemical formula 2.

Examples of fillers usable for the heat-resistant lubricating layer 4 include inorganic fillers, e.g., silica, talc, clay, zeolite, titanium oxide, zinc oxide, and carbon, and organic fillers, e.g., silicone resins, Teflon resins, and benzoguanamine resins. Here, the silicone resins serving as the filler form unevenness in such a way that a contact surface between the thermal transfer dye layers 3 and the heat-resistant lubricating layer 4 is reduced in preservation after rolling and facilitate the sliding performance.

However, if the amounts of addition of them are too large, poor drying may occur in film formation of the heat-resistant lubricating layer 4 and blocking is invited easily in the state of rolling. Therefore, the amounts of addition are controlled appropriately.

Regarding the thermal transfer sheet 1 having the above-described configuration, since the heat-resistant lubricating layer 4 contains at least one type of silicone compound represented by Chemical formula 1 or Chemical formula 2, the heat-resistant lubricating layer 4 is provided with the lubricity, the friction coefficient between the thermal head and the thermal transfer sheet 1 is reduced even in a high-temperature environment, so that the friction coefficient can be stabilized. Furthermore, regarding this thermal transfer sheet 1, the compounds contained in the heat-resistant lubricating layer 4 and represented by Chemical formula 1 and Chemical formula 2 have high melting points and low volatility and are hard to decompose. Consequently, the compounds are not dissolved due to heat, and the thermal head is not stained during image printing. Moreover, regarding the preservation, even when preservation after rolling is conducted in a high-temperature environment, the dyes in the thermal transfer dye layers 3 (3Y, 3M, 3C) are not eluted, the thermal transfer dye layers 3 (3Y, 3M, 3C) are not adversely affected, and excellent preservation stability is exhibited. Therefore, in the case where image printing is conducted by using this thermal transfer sheet 1, the running speed is constant, and the thermal head is not stained, so that the heat is transmitted to the thermal transfer dye layers 3 (3Y, 3M, 3C) appropriately. Furthermore, since elution of the dyes during preservation can be prevented, a reduction in density, image printing variations, and the like do not occur, and a high-quality image can be formed.

EXAMPLES

Specific examples according to an embodiment of the present invention will be described below in detail with reference to experimental results. First, the silicone compound will be described.

Synthesis of Silicone Compound 1

A reaction of 7.5 g of dual-end amino-modified silicone oil (trade name X-22-161B, produced by Shin-Etsu Chemical Co., Ltd.), 3.6 g of stearic acid chloride (produced by NOF CORPORATION), and 1.2 g of triethylamine in 100 ml of methyl ethyl ketone (MEK) was conducted with reflux for 24 hours. Thereafter, removal of the solvent, cleaning with a toluene-water mixed solvent, and separation of liquid were conducted so as to take an organic solvent layer.

Subsequently, the organic solvent was removed, and cooling was conducted so as to obtain a solid matter. The resulting solid matter was dissolved into acetone. Recrystallization, filtration, and drying were conducted so as to obtain desired Silicone compound 1. The melting point of the resulting Silicone compound 1 was 69° C. Silicone compound 1 was comparable to the silicone compound shown as Chemical compound 6 described above.

Synthesis of Silicone Compound 2

A reaction of 11 g of dual-end amino-modified silicone oil (trade name KF-8012, produced by Shin-Etsu Chemical Co., Ltd.), 3.6 g of stearic acid chloride (produced by NOF CORPORATION), and 1.2 g of triethylamine in 100 ml of MEK was conducted with reflux for 24 hours. Thereafter, removal of the solvent, cleaning with a toluene-water mixed solvent, and separation of liquid were conducted so as to take an organic solvent layer.

Subsequently, the organic solvent was removed, and cooling was conducted so as to obtain a solid matter. The resulting solid matter was dissolved into acetone. Recrystallization, filtration, and drying were conducted so as to obtain desired Silicone compound 2. The melting point of the resulting Silicone compound 2 was 67° C. Silicone compound 2 was comparable to the silicone compound shown as Chemical compound 15 described above.

Synthesis of Silicone Compound 3

A reaction of 28 g of dual-end amino-modified silicone oil (trade name KF-8008, produced by Shin-Etsu Chemical Co., Ltd.), 3.6 g of stearic acid chloride (produced by NOF CORPORATION), and 1.2 g of triethylamine in 100 ml of MEK was conducted with reflux for 24 hours. Thereafter, removal of the solvent, cleaning with a toluene-water mixed solvent, and separation of liquid were conducted so as to take an organic solvent layer.

Subsequently, the organic solvent was removed, and cooling was conducted so as to obtain a solid matter. The resulting solid matter was dissolved into acetone. Recrystallization, filtration, and drying were conducted so as to obtain desired Silicone compound 3. The melting point of the resulting Silicone compound 3 was 66° C. Silicone compound 3 was comparable to the silicone compound shown as Chemical compound 7 described above.

Synthesis of Silicone Compound 4

A reaction of 11 g of dual-end amino-modified silicone oil (trade name X-22-1660B-3, produced by Shin-Etsu Chemical Co., Ltd.), 3.6 g of stearic acid chloride (produced by NOF CORPORATION), and 1.2 g of triethylamine in 100 ml of MEK was conducted with reflux for 24 hours. Thereafter, removal of the solvent, cleaning with a toluene-water mixed solvent, and separation of liquid were conducted so as to take an organic solvent layer.

Subsequently, the organic solvent was removed, and cooling was conducted so as to obtain a solid matter. The resulting solid matter was dissolved into acetone. Recrystallization, filtration, and drying were conducted so as to obtain desired Silicone compound 4. The melting point of the resulting Silicone compound 4 was 59° C. Silicone compound 4 was comparable to the silicone compound shown as Chemical compound 8 described above.

Thermal transfer sheets were formed by using these synthesized Silicone compounds 1 to 4 by the following method.

First, a polyester film (trade name Lumirror, produced by Toray Industries, Ltd.) having a thickness of 6 μm was used as a base material sheet, and one surface thereof was coated with the following ink compositions in such a way that the thickness became 1 μm after drying, followed by drying.

| | |
|---|---|
| Yellow ink<br>Foron Yellow (produced by Sandoz K.K.) | 5.0 parts by mass |
| Polyvinyl butyral resin (trade name BX-1, produced by Sekisui Chemical Co., Ltd.) | 5.0 parts by mass |
| Methyl ethyl ketone | 45.0 parts by mass |
| Toluene | 45.0 parts by mass |

-continued

| | |
|---|---|
| Magenta ink | |
| Foron red | 2.5 parts by mass |
| Anthraquinone dye (trade name ESC451, produced by Sumitomo Chemical Co., Ltd.) | 2.5 parts by mass |
| Polyvinyl butyral resin (trade name BX-1, produced by Sekisui Chemical Co., Ltd.) | 5.0 parts by mass |
| Methyl ethyl ketone | 45.0 parts by mass |
| Toluene | 45.0 parts by mass |
| Cyan ink | |
| Foron Blue (produced by Sandoz K.K.) | 2.5 parts by mass |
| Indoaniline dye (structural formula is shown as Chemical compound 32 described below) | 2.5 parts by mass |
| Polyvinyl butyral resin (trade name BX-1, produced by Sekisui Chemical Co., Ltd.) | 5.0 parts by mass |
| Methyl ethyl ketone | 45.0 parts by mass |
| Toluene | 45.0 parts by mass |

[Chemical compound 32]

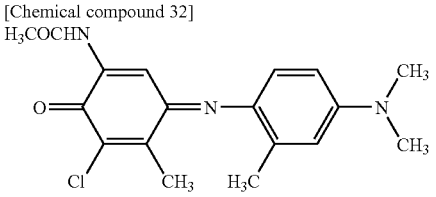

Next, a surface of the base material sheet opposite to the surface coated with the thermal transfer dye layers was coated with a heat-resistant lubricating layer composed of the following composition in such a way that the thickness became 1 μm after drying and, thereby, thermal transfer sheets of Example 1 to Example 8 were obtained.

Example 1 to Example 8

Composition of Heat-Resistant Lubricating Layer

Polyacetal resin 100 parts by mass (trade name DENKA BUTYRAL #3000K, produced by DENKI KAGAKU KOGYO K.K.)

Polyisocyanate 20 parts by mass (trade name Coronate L, NIPPON POLYURETHANE INDUSTRY CO., LTD.)

Spherical silica 3 parts by mass (TOSPEARL XC99, produced by Toshiba Silicone Co., Ltd.)

Organic solvent (methyl ethyl ketone:toluene=1:1)

1,900 parts by mass

The types and the amounts of addition of silicone compounds and phosphate esters of Example 1 to Example 8 and Comparative example 1 to Comparative example 6 are shown in Table 1 described below.

TABLE 1

| | Lubricant | Parts by mass |
|---|---|---|
| Example 1 | Silicone compound 1 | 20 |
| Example 2 | Silicone compound 2 | 20 |
| Example 3 | Silicone compound 3 | 20 |
| Example 4 | Silicone compound 4 | 20 |
| Example 5 | Silicone compound 1 | 10 |
| | phosphate ester | 10 |
| Example 6 | Silicone compound 2 | 10 |
| | phosphate ester | 10 |
| Example 7 | Silicone compound 3 | 10 |
| | phosphate ester | 10 |
| Example 8 | Silicone compound 4 | 10 |
| | phosphate ester | 10 |

TABLE 1-continued

| | Lubricant | Parts by mass |
|---|---|---|
| Comparative example 1 | myristic acid | 20 |
| Comparative example 2 | butyl stearate | 20 |
| Comparative example 3 | hexaglyceryl pentastearate | 20 |
| Comparative example 4 | phosphate ester | 20 |
| Comparative example 5 | Silicone compound 1 | 40 |
| | phosphate ester | 100 |
| Comparative example 6 | silicone oil | 20 |

The phosphate ester used here was a trade name PHOSPHANOL RL-210 produced by TOHO Chemical Industry Co., Ltd.

Comparative Example 1 to Comparative Example 6

In a manner similar to that in Example 1 to Example 8, a surface of the base material sheet opposite to the surface coated with the thermal transfer dye layers was coated with a heat-resistant lubricating layer composed of the following composition in such a way that the thickness became 1 μm after drying and, thereby, thermal transfer sheets were obtained.

| Composition of heat-resistant lubricating layer | |
|---|---|
| Polyacetal resin (trade name DENKA BUTYRAL #3000K, produced by DENKI KAGAKU KOGYO K.K.) | 100 parts by mass |
| Polyisocyanate (trade name Coronate L, produced by NIPPON POLYURETHANE INDUSTRY CO., LTD.) | 20 parts by mass |
| Spherical silica (TOSPEARL XC99, produced by Toshiba Silicone Co., Ltd.) | 3 parts by mass |
| Organic solvent (methyl ethyl ketone:toluene = 1:1) | 1,900 parts by mass |

As for lubricants in Comparative examples, myristic acid (LUNAC MY-98, produced by Kao Corporation), butyl stearate (NIKKOL BS, produced by Nikko Chemicals Co., Ltd.), hexaglyceryl pentastearate (trade name NIKKOL HEXAGLYN-5S, produced by Nikko Chemicals Co., Ltd.), phosphate ester (trade name PHOSPHANOL RL-210, produced by TOHO Chemical Industry Co., Ltd.), and silicone oil (trade name X-22-161B, produced by Shin-Etsu Chemical Co., Ltd.) were added and mixed at proportions shown in Table 1 and, thereby, thermal transfer sheets were prepared in a manner similar to that in Example 1 to Example 8.

Figure 6:
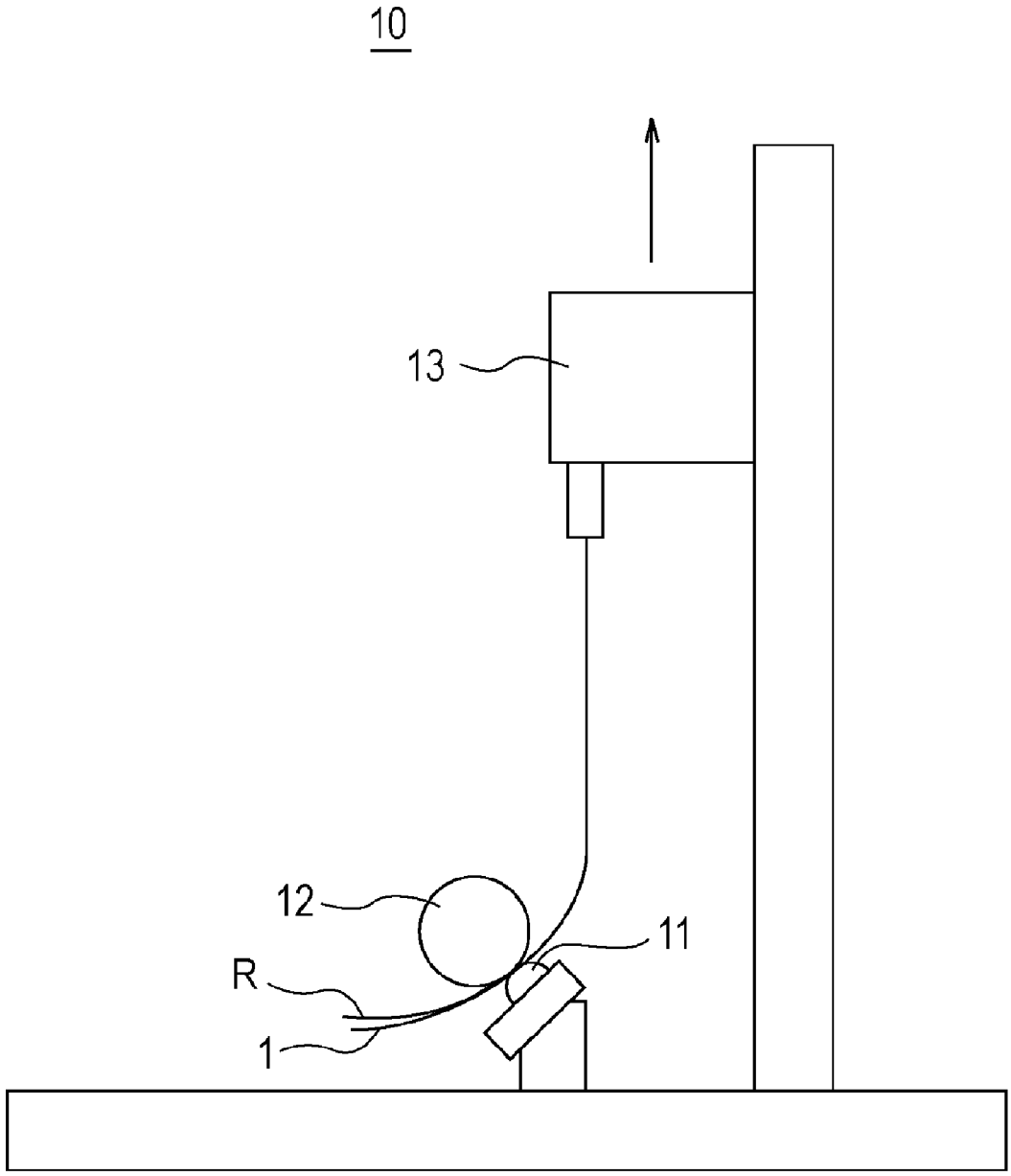
FIG. 6 is a schematic diagram of a friction measuring apparatus.

Regarding these thermal transfer sheets formed in Examples and Comparative examples, the friction coefficient, the running smoothness, the sticking, the dye preservation performance, and the thermal head staining resistance were measured. The friction coefficient was measured by using a friction measuring apparatus 10 shown in FIG. 6. Regarding this friction measuring apparatus 10, a thermal transfer sheet 1 and photographic paper R are sandwiched between a thermal head 11 and a platen roll 12, the thermal transfer sheet 1 and the photographic paper R are pulled up with a tension gauge 13 and, thereby, a tension is measured. The measurement condition is as described below.

| Measurement condition | |
|---|---|
| Thermal transfer sheet feed speed: | 450 mm/min |
| Signal setting | |
| Print pattern: | 2 (Stair Step) |
| Original: | 3 (48/672 lines, 14 steps) |
| Strobe division: | 1 |
| Strobe pulse width: | 20.0 msec |
| Printing speed: | 22.0 msec/1 line |
| Clock: | 3 (4 MHz) |
| Head voltage: | 18.0 V |

Furthermore, the running smoothness, the sticking, and the thermal head staining resistance were evaluated by using the following methods. That is, the resulting thermal transfer sheet was mounted on a full color printer (trade name UP-D7000) produced by Sony Corporation, and gray-scale image printing (with a 16-step gradation) was conducted on photographic paper (trade name UPC7010 produced by Sony Corporation). The running smoothness (variations in image printing, wrinkle generation, and deviation in image printing) and the sticking were checked visually.

Regarding the running smoothness, a symbol ⊙ indicates that the result was good, and a symbol x indicates that wrinkles and the like were generated. Regarding the sticking, the symbol ⊙ indicates that no sticking occurred, and the symbol x indicates that sticking occurred.

Regarding the thermal head staining resistance, gray-scale image printing was repeated 5,000 times and, thereafter, the thermal head surface was observed with an optical microscope. The symbol ⊙ indicates that the result was good, and the symbol x indicates that adhered materials were observed and, therefore, staining occurred.

Moreover, regarding the dye preservation performance, the resulting two thermal transfer sheets (20 cm×20 cm) were stacked in such a way that the thermal transfer dye layers of one sheet faced the heat-resistant lubricating layer of the other sheet. The two sheets were sandwiched between two glass plates, a load was applied from above with a 5-kg weight, and preservation was conducted in an oven at 50° C. for 48 hours. The thermal transfer sheets before and after the preservation were mounted on the full color printer (trade name UP-D7000) produced by Sony Corporation, and gray-scale image printing (with a 16-step gradation) was conducted on photographic paper (trade name UPC7010 produced by Sony Corporation). A maximum density of each color was measured by a reflection density measurement with Macbeth densitometer (trade name TR-924). The dye preservation performance was evaluated on the basis of a calculation result of maximum density after preservation/maximum density before preservation×100(%). The results are shown in Table 2.

TABLE 2

| | Friction coefficient (min) | Friction coefficient (max) | Running smoothness | Sticking | Dye preservation performance | Thermal head staining resistance |
|---|---|---|---|---|---|---|
| Example 1 | 0.17 | 0.19 | ⊙ | ⊙ | 100 | ⊙ |
| Example 2 | 0.19 | 0.20 | ⊙ | ⊙ | 99 | ⊙ |
| Example 3 | 0.17 | 0.19 | ⊙ | ⊙ | 100 | ⊙ |
| Example 4 | 0.17 | 0.19 | ⊙ | ⊙ | 98 | ⊙ |
| Example 5 | 0.15 | 0.18 | ⊙ | ⊙ | 96 | ⊙ |
| Example 6 | 0.15 | 0.19 | ⊙ | ⊙ | 96 | ⊙ |
| Example 7 | 0.13 | 0.18 | ⊙ | ⊙ | 96 | ⊙ |
| Example 8 | 0.15 | 0.19 | ⊙ | ⊙ | 95 | ⊙ |
| Comparative example 1 | 0.21 | 0.26 | X | X | 97 | X |
| Comparative example 2 | 0.20 | 0.25 | X | X | 99 | X |
| Comparative example 3 | 0.19 | 0.25 | X | X | 100 | X |
| Comparative example 4 | 0.17 | 0.25 | ⊙ | ⊙ | 85 | ⊙ |
| Comparative example 5 | 0.14 | 0.17 | ⊙ | X | 70 | X |
| Comparative example 6 | 0.13 | 0.15 | ⊙ | X | 50 | X |

As is clear from the results shown in Table 2, regarding all of Example 1 to Example 8 in which one of Silicone compound 1 to Silicone compound 4 was contained in the heat-resistant lubricating layer, the running smoothness was good, sticking along with an increase in friction was not observed, and sharp images were obtained. Furthermore, regarding Example 1 to Example 8, the dye preservation performance of 90% or more was achieved and, therefore, there was substantially no problem in practical use. Moreover, as a result of observation of the thermal heads in Example 1 to Example 8, substantially no staining of thermal head surface occurred, repetition of image printing was not affected and, therefore, good images were obtained.

On the other hand, regarding all of Comparative example 1 to Comparative example 3 in which the fatty acid and the fatty acid esters were used, sticking was observed and satisfactory results were not obtained. Moreover, as a result of observation of the thermal heads in Comparative example 1 to Comparative example 3, there were adhered materials on the thermal head surfaces and, therefore, it was ascertained that staining of thermal heads occurred.

In Comparative example 4 in which phosphate ester was used alone, regarding the dye preservation performance, a significant reduction in the density after the preservation was observed and, therefore, a satisfactory result was not obtained. Moreover, in Comparative example 4, the maximum value of the friction coefficient was large and, therefore, sufficient lubricity was not obtained.

In Comparative example 5 in which large amounts of Silicone compound 1 and phosphate ester were added, regarding the dye preservation performance, a significant reduction in the density after the preservation was observed and, therefore, a satisfactory result was not obtained. Moreover, as a result of observation of the thermal head in Comparative example 5, there were adhered materials on the thermal head surface and, therefore, it was ascertained that staining of thermal head occurred.

In Comparative example 6 in which the silicone oil was used, a film having a small friction coefficient was able to be obtained. However, regarding the dye preservation performance, a significant reduction in the density after the preservation was observed and, therefore, a satisfactory result was not obtained. Moreover, as a result of observation of the thermal head in Comparative example 6, there was adhesion of oil on the thermal head surface and, therefore, it was ascertained that staining of thermal head occurred.

As described above, it is clear that in the case where the heat-resistant lubricating layer of the thermal transfer sheet contains a silicone compound represented by Chemical formula 1 or Chemical formula 2, the friction coefficient between the thermal head and the thermal transfer sheet can be reduced, good running smoothness is exhibited, sticking can be prevented, good dye preservation performance is exhibited, the staining of the thermal head can be prevented and, therefore, a good image can be obtained.

The present application contains subject matter related to that disclosed in Japanese Priority Patent Application JP 2008-123668 filed in the Japan Patent Office on May 9, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal transfer sheet comprising:

a base material sheet comprising a top surface and a bottom surface opposite to the top surface;

a thermal transfer dye layer containing a dye, the thermal transfer dye layer is disposed on the top surface of the base material sheet and a heat-resistant lubricating layer is disposed on the bottom surface of the base material sheet, wherein, the heat-resistant lubricating layer contains at least one silicone compound represented by Chemical formula 1 or Chemical formula 2, Chemical formulae 1 and 2 being, Chemical formula 1

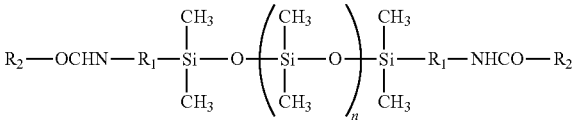

Chemical formula 2

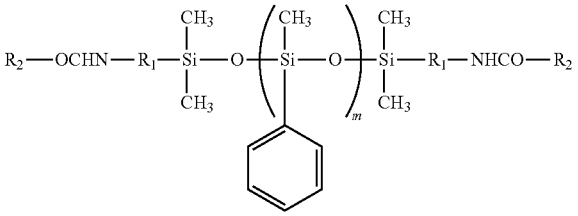

where in each of Chemical formula 1 and Chemical formula 2, each of $R_1$ contains an alkyl group, an alkylene group, a phenyl group, an ether group or an ester group, each of $R_2$ represents an alkyl group or an alkylene group having the carbon number of 1 to 50, and n and m represent individually an integer of 1 to 200.

2. The thermal transfer sheet according to claim 1, wherein the melting point of the silicone compound represented by Chemical formula 1 or Chemical formula 2 is 59° C. or higher.

3. The thermal transfer sheet according to claim 1, wherein the amount of silicone compound represented by Chemical formula 1 or Chemical formula 2 is 10 to 20 percent by mass.

* * * * *